US005988321A

United States Patent [19]

Kondo

[11] Patent Number: 5,988,321

[45] Date of Patent: Nov. 23, 1999

[54] ELEVATOR DOOR APPARATUS

[75] Inventor: Takeharu Kondo, Tokyo, Japan

[73] Assignee: Mitsubishi Denki Kabushiki Kaisha, Tokyo, Japan

[21] Appl. No.: 09/038,913

[22] Filed: Mar. 12, 1998

[30] Foreign Application Priority Data

Oct. 28, 1997 [JP] Japan ..... 9-295688

[51] Int. Cl.[6] ..... B66B 13/06

[52] U.S. Cl. ..... 187/333; 49/501

[58] Field of Search ..... 187/314, 333, 187/325, 334, 400; 49/116, 118, 120, 501, 504

[56] References Cited

U.S. PATENT DOCUMENTS

| | | | |
|---|---|---|---|
| 3,981,102 | 9/1976 | Harwood et al. | 49/501 |
| 4,530,189 | 7/1985 | Randall | 49/504 X |
| 5,016,395 | 5/1991 | Walker et al. | 49/501 |
| 5,156,237 | 10/1992 | Hayashi et al. | 49/120 X |
| 5,165,505 | 11/1992 | Hayashi et al. | 187/333 |
| 5,293,962 | 3/1994 | Pelvilain | 49/120 X |
| 5,377,784 | 1/1995 | Walkowiak et al. | 49/120 X |
| 5,836,424 | 11/1998 | Allen | 187/333 |
| 5,899,303 | 5/1999 | Allen | 187/333 |

FOREIGN PATENT DOCUMENTS

| | | |
|---|---|---|
| 0551961 | 1/1993 | European Pat. Off. . |
| 2491538 | 10/1980 | France . |
| 2919951 | 5/1979 | Germany . |
| 3239177 | 10/1982 | Germany . |
| 3803317 | 2/1988 | Germany . |
| 61-75189 | 4/1986 | Japan . |
| 62-47588 | 3/1987 | Japan . |
| 4272086 | 9/1992 | Japan . |
| 9401478 | 9/1994 | Netherlands . |

*Primary Examiner*—David A. Bucci
*Attorney, Agent, or Firm*—Leydig, Voit & Mayer, Ltd.

[57] ABSTRACT

In an elevator door apparatus, landing fire protection members having engaging portions extending in a direction parallel to an opening and closing direction of landing doors are fixed at door recess portions of an entrance. Further, door side fire prevention plates extending in a direction perpendicular to the opening and closing direction of the landing doors are fixed to side end portions of the landing doors. Insert holes in which the engaging portions are inserted when the doors are closed are provided in the door side fire prevention plates. When a fire occurs, the engaging portions are brought into contact with the side edge portions of the insert holes, which restricts warping of the landing doors.

5 Claims, 8 Drawing Sheets

ELEVATOR DOOR APPARATUS

BACKGROUND OF THE INVENTION

1. Field of the Invention

The present invention relates to an elevator door apparatus, particularly to an improvement in the fire protection construction thereof.

2. Description of the Related Art

FIG. 7 is a horizontal cross sectional view showing a conventional elevator door apparatus. In the drawing, an entrance 2 is provided in a landing wall 1. A jamb 3 is fixed to side edge portions and an upper edge portion of the entrance 2. End portions of the jamb 3 close to a hoist way 4 are bent in an L-shaped manner toward an inner portion of a door recess portion 5 to constitute a landing side engaging portion 3*a*. A pair of landing doors (fireproof doors) 6 for opening and closing the entrance 2 are provided at the inner side of the entrance 2. A fire protection member 7 is fixed to each opening side end portion of the landing doors 6. A door side engaging portion 7*a* having a U-shaped cross section is formed in each fire protection member 7 in such a manner as to oppose both surfaces of the landing side engaging portion 3*a* when the doors 6 are closed.

Next, FIG. 8 is a cross sectional view showing a deformed state of the landing doors 6 shown in FIG. 7 when there is a fire, and FIG. 9 is a cross sectional view taken along a line IX—IX in FIG. 8. When a fire occurs in the landing entrance side, the landing doors 6 are deformed by heat in the manner shown in FIGS. 8 and 9. At this time, the door side engaging portions 7*a* are brought into contact with the landing side engaging portions 3*a*, so that the deformation (warping) of the landing doors 6 is restricted. Accordingly, a large gap is prevented from developing between the landing entrance and the hoist way 4 due to the warping of the landing doors 6 and the fire is prevented from entering the hoist way 4. Here, the warp of the landing doors 6 is exaggerated in FIGS. 8 and 9 for easier understanding.

In the conventional elevator door apparatus having the above construction, since the door side engaging portions 7*a* project from the side end portions of the landing doors 6 in the direction that the doors open, in order to secure a clearance c with respect to the side wall of the hoist way 4 in the door open state (broken lines in FIG. 7), the width $d_o$ of the hoist way 4 must be increased at least twice the distance e (for example, 100 mm) that the door side engaging portion 7*a* projects compared to when fire protection members 7 are not used, so that the area of the building that the hoist way 4 occupies increases. Furthermore, it is necessary to determine if fire protection members 7 are to be provided at the building design stage, and this decreases design flexibility.

SUMMARY OF THE INVENTION

The present invention is made to solve the problems mentioned above, and an object of the present invention is to provide an elevator door apparatus which can prevent a landing door from being deformed by a fire and which also allow the width of a hoist way to be smaller.

To this end, according to one aspect of the present invention, there is provided an elevator door apparatus comprising: a landing door for opening and closing an entrance of a landing; a landing fire protection member fixed at a door recess portion of the entrance and having an engaging portion extending in a direction parallel to an opening and closing direction of the landing door; and a plate-shaped door side fire protection member fixed to a side end portion of the landing door and extending in a direction perpendicular to the opening and closing direction of the landing door, the door side fire protection member having an insert hole in which the engaging portion is inserted when the landing door is closed.

DETAILED DESCRIPTION OF THE PREFERRED EMBODIMENTS

An embodiment of the present invention will be described below with reference to the accompanying drawings.

First Embodiment

Figure 1:
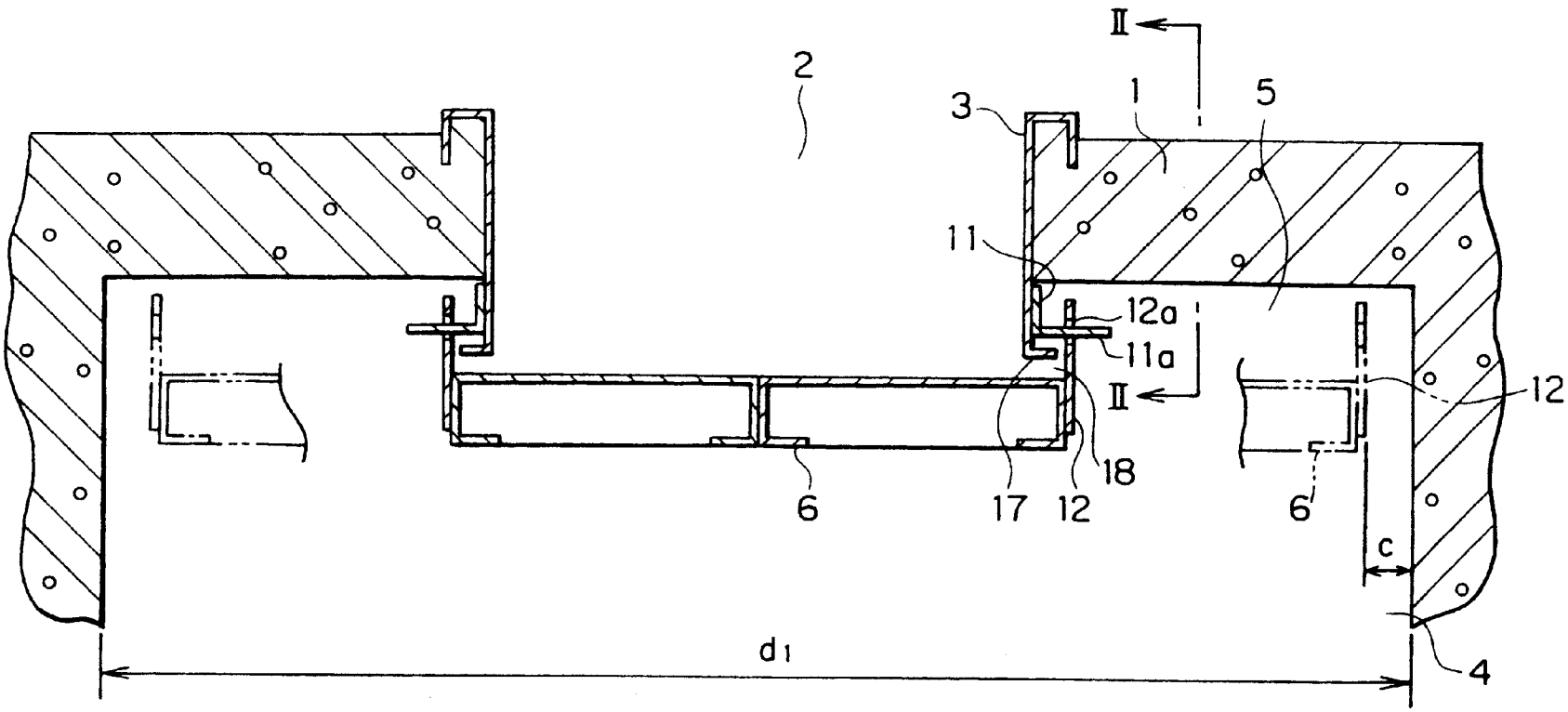
FIG. 1 is a horizontal cross sectional view showing an elevator door apparatus in accordance with a first embodiment of the present invention.
Figure 2:
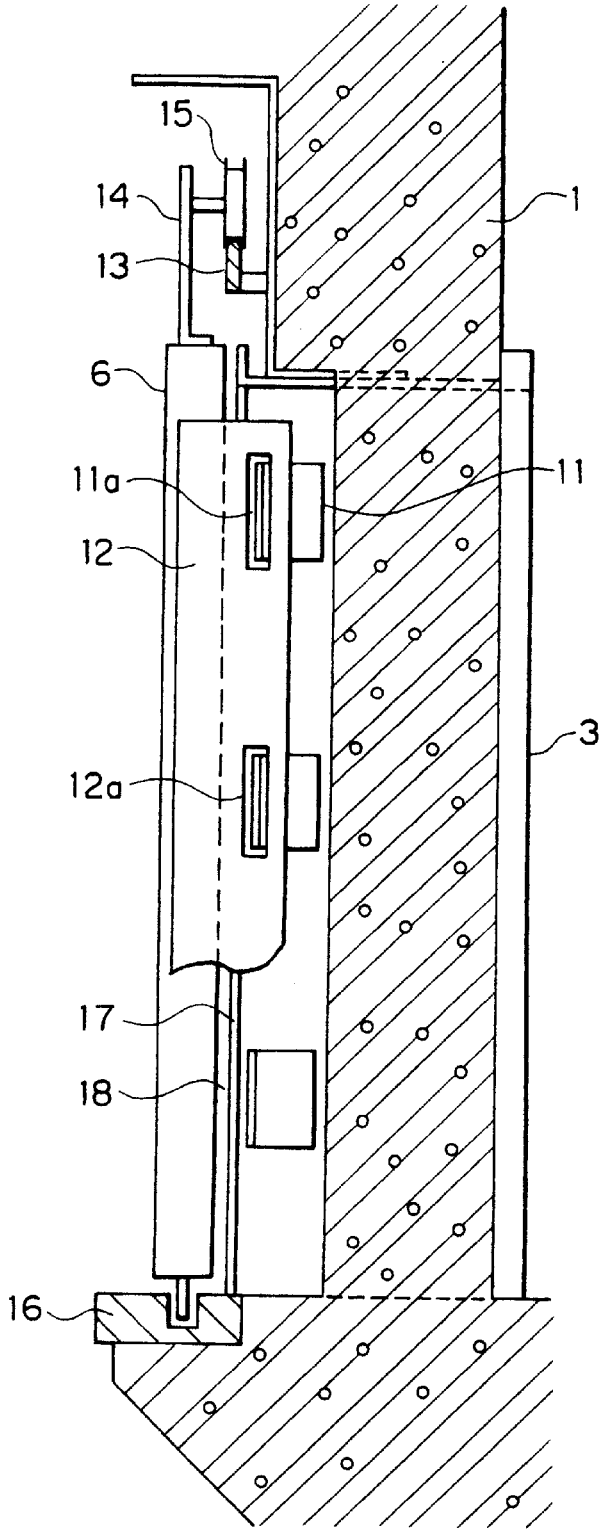
FIG. 2 is a cross sectional view taken along a line II—II in FIG. 1.

FIG. 1 is a horizontal cross sectional view showing an elevator door apparatus in accordance with a first embodiment of the present invention and FIG. 2 is a cross sectional view taken along a line II—II in FIG. 1.

In the drawings, an entrance 2 is provided in a landing wall 1. A jamb 3 is fixed to side edge portions and an upper edge portion of the entrance 2. A pair of landing doors (fireproof doors) 6 for opening and closing the entrance 2 are provided at the inner side of the entrance 2. A plurality of landing fire protection members 11 each having an L-shaped cross section are fixed to end portions of the hoist way 4 side of the jamb 3, that is to say, at the door recess portions 5, such that they have intervals therebetween in the height direction (the vertical direction in FIG. 2). Each landing fire protection member 11 has a plate-shaped engaging portion 11*a* that extends in a direction parallel to the opening and closing direction (the horizontal direction in FIG. 1) of the landing doors 6.

A plate-shaped door side fire protection member 12 that extends in a direction perpendicular to the opening and closing direction of the landing doors 6 is fixed to an opening side end portion of each landing door 6. Each door side fire protection member 12 has insert holes 12*a* in which the engaging portions 11*a* are inserted when the doors 6 are closed.

Further, in FIG. 2, a door rail 13 extending in the opening and closing direction of the landing doors 6 is fixed to an upper portion of the entrance 2. Door hangers 14 are fixed to upper end portions of the landing doors 6. Hanger rollers 15 that roll along the door rail 13 are mounted to the door hangers 14. Further, a sill 16 guiding lower end portions of the landing doors 6 is fixed to the landing floor.

Figure 8:
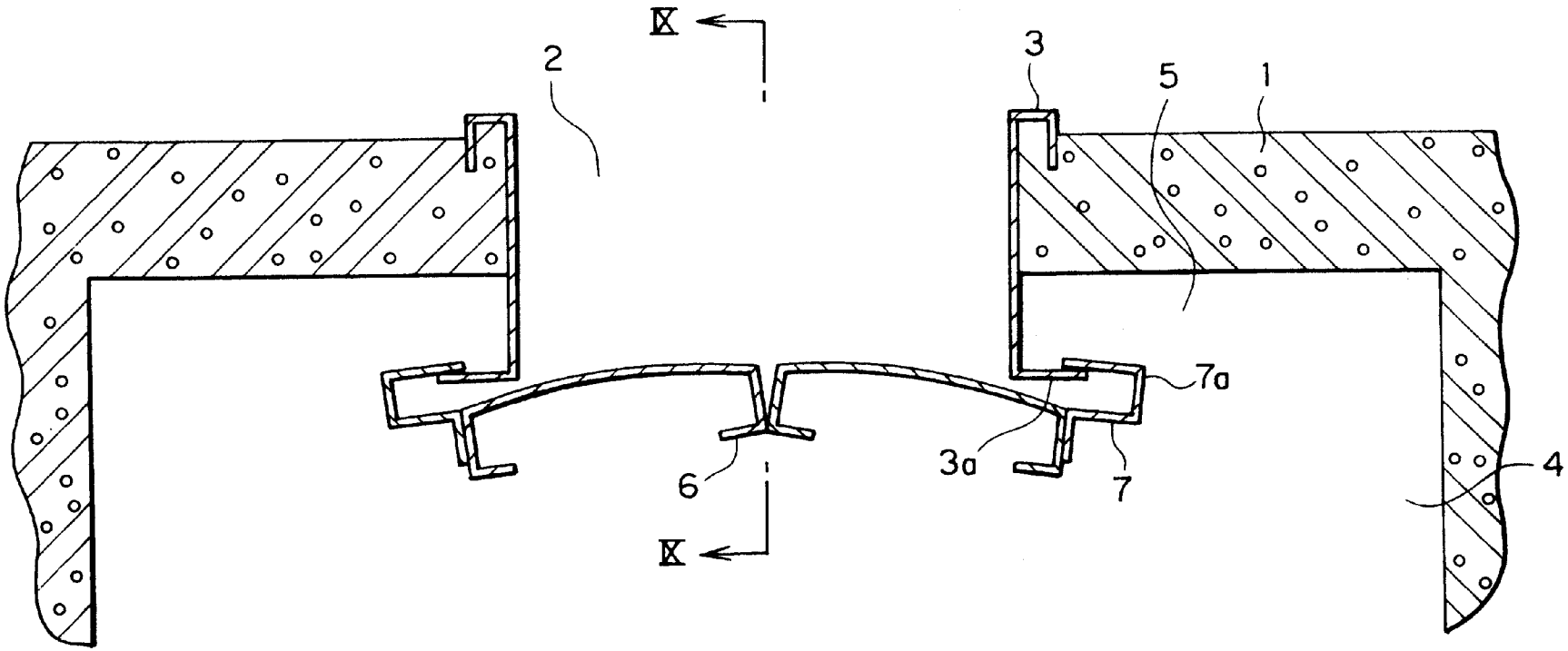
FIG. 8 PRIOR ART
FIG. 8 is a cross sectional view showing a deformed state of a landing door in FIG. 7 when there is a fire.

In such a door apparatus, when a fire occurs at the landing, the landing doors 6 are deformed in the same manner as in FIG. 8. At this time, since the side edge portions of the insert holes 12*a* of the door side fire protection members 12 are brought into contact with the engaging portions 11*a*, deformation of the landing doors 6 is restricted, so that fire is prevented from entering the hoist way 4. Further, since the plate-shaped door side fire protection members 12 are used, only the thickness of the door side fire protection member 12 projects from the end portion of the landing door 6, so that a width $d_1$ of the hoist way 4 can be made smaller than the width $d_o$ of the conventional apparatus ($d_1<d_0$) while still securing a clearance c when the doors 6 are opened (broken lines in FIG. 1). Accordingly, the area of the building that the hoist way 4 occupies can be decreased and design flexibility can be increased.

Furthermore, since a bent portion 17, bent in an L-shape, is provided on each end portion of the hoist way 4 side of the jamb 3 along the entire height thereof, a narrow path 18 is formed by the surrounding bent portion 17, the landing door 6, and the door side fire protection member 12 along the entire height of the landing door 6, so that fire can be reliably prevented from entering the hoist way 4.

Although in the above embodiment, the landing fire protection members 11 are fixed to the jamb 3, as long as the landing fire protection members 11 are fixed within the door recess portion 5, they may also be fixed to the landing wall 1 through other members.

Although in the above embodiment, the bent portions 17 are provided at the jamb 3, members for constituting the narrow paths 18 can be fixed to the landing wall 1.

Second Embodiment

Figure 3:
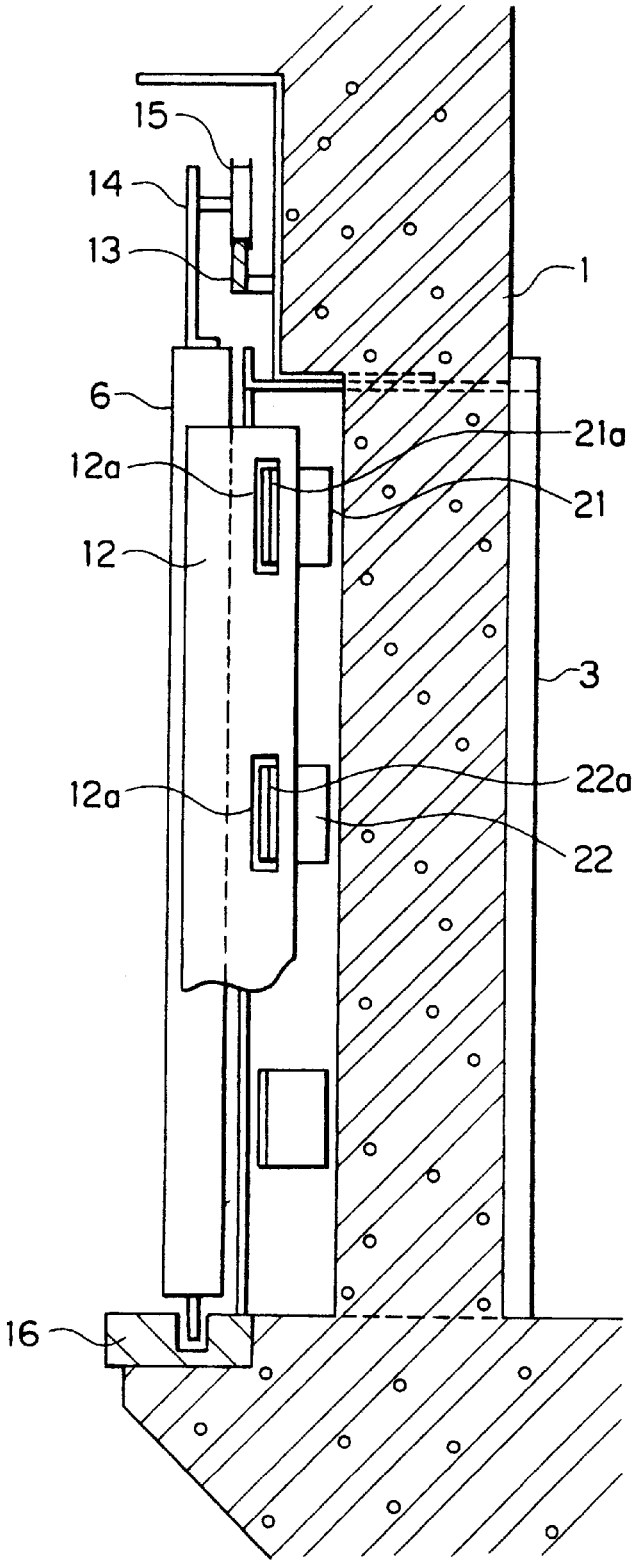
FIG. 3 is a cross sectional view showing an elevator door apparatus in accordance with a second embodiment of the present invention.

Next, FIG. 3 is a cross sectional view of an elevator door apparatus in accordance with a second embodiment of the present invention, which corresponds to a cross section taken along a line II—II in FIG. 1. In the drawing, a plurality of landing fire protection members 21 and 22 each having an L-shaped cross section are fixed to end portions of the hoist way 4 side of the jamb 3 such that intervals are provided therebetween in the height direction. The landing fire protection members 21 and 22 respectively have engaging portions 21*a* and 22*a* extending a direction parallel to the opening and closing direction of the landing doors 6. Further, the landing fire protection member 21 positioned at the uppermost portion has a thickness greater than the other landing fire protection members 22, and is strongly welded to the jamb 3.

Figure 9:
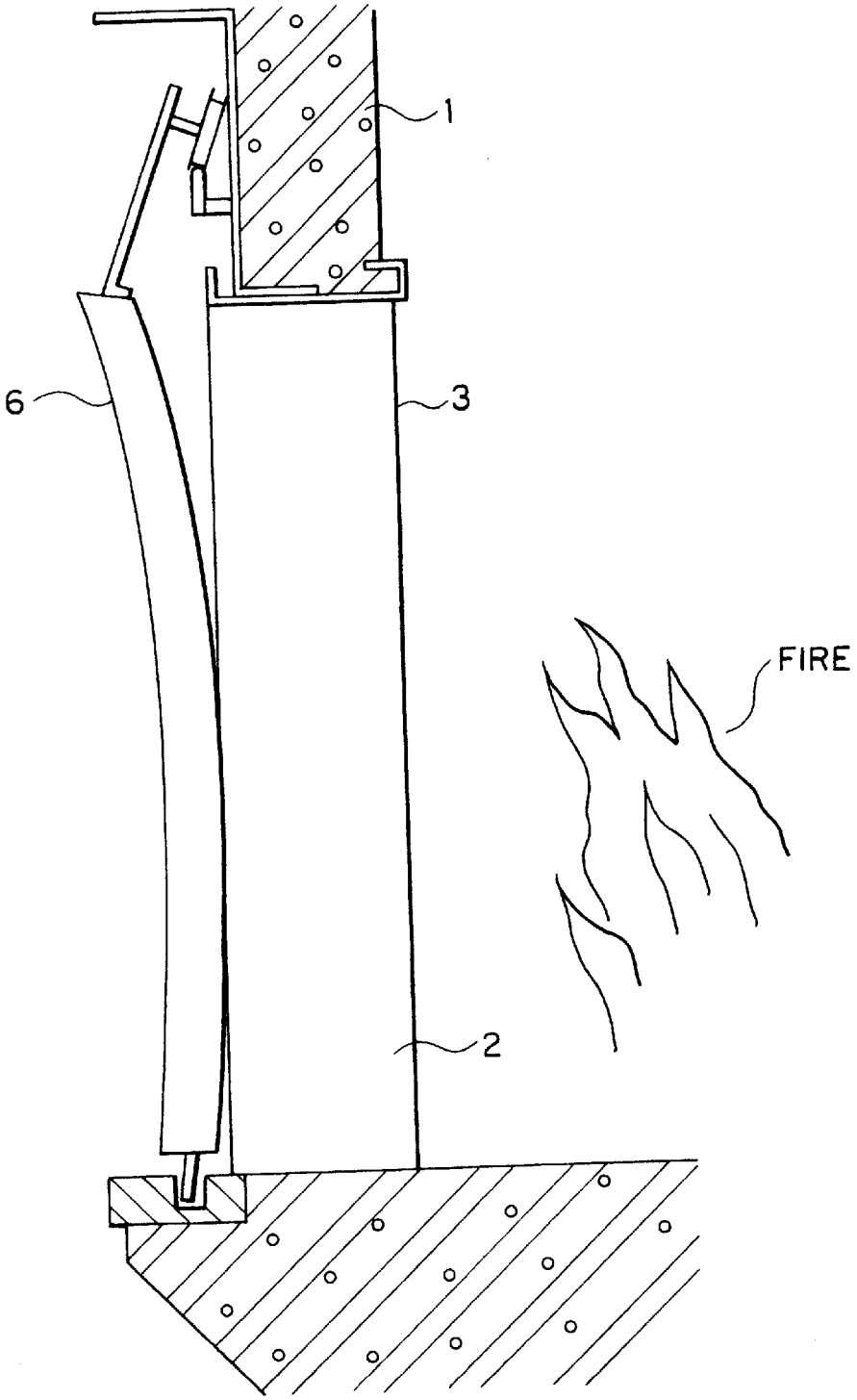
FIG. 9 PRIOR ART
FIG. 9 is a cross sectional view taken along a line IX—IX in FIG. 8.

Here, when a fire occurs at the landing side, the greatest deformation and the greatest force, with respect to the vertical direction of landing door 6, is generated at the upper end portion of the landing door 6 as shown in FIG. 9. Consequently, in this embodiment, the warping of the landing doors 6 can be efficiently restrained because the landing fire protection members 21 at the uppermost portions of landing doors 6 are strongly welded and made relatively thicker to correspond to the large magnitude of force generated by the warping of landing door 6, while the other landing fire protection members are made relatively thinner. Accordingly, it is not necessary to make the strength of the landing fire protection members 22 greater than necessary, and manufacturing costs can be reduced.

In the above embodiment, a plurality of inserting holes 12*a* are provided in one door side fire protection member 12. Nevertheless, the door side fire protection member 12 may be divided into a plurality of portions, and an insert hole 12*a* may be provided in each of them. In this case, the thickness of the door side fire protection members and the welding strengths thereof can be structured to be different from each other, and the strengths of the insert holes can be structured to be different from each other to correspond to the magnitude of the force generated by the warping of the landing door 6.

Further, a plurality of engaging portions can be provided on one landing fire protection member.

Third Embodiment

Figure 4:
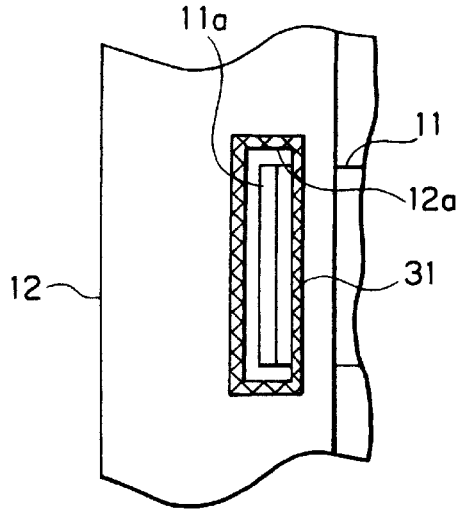
FIG. 4 is a schematic view showing an essential portion of an elevator door apparatus in accordance with a third embodiment of the present invention.

Next, FIG. 4 is a schematic view showing an essential portion of an elevator door apparatus in accordance with an third embodiment of the present invention. In this embodiment, thermal expansion members 31 are attached to peripheral edge portions of the insert holes 12*a* of the door side fire protection members 12. A ceramic fiber composite material or the like whose volume expands 10 to 15 times with heating may for example, be used as the thermal expansion member 31. The other constructions are the same as those of the first and second embodiments.

In this door apparatus, when the thermal expansion members 31 are heated by a fire they expand, and close-off the peripheries of the engaging portions 11*a* in the insert holes 12*a*. Accordingly, fire is prevented from entering the hoist way 4 through the insert holes 12*a*, and fireproof performance is further improved.

Fourth Embodiment

Figure 5:
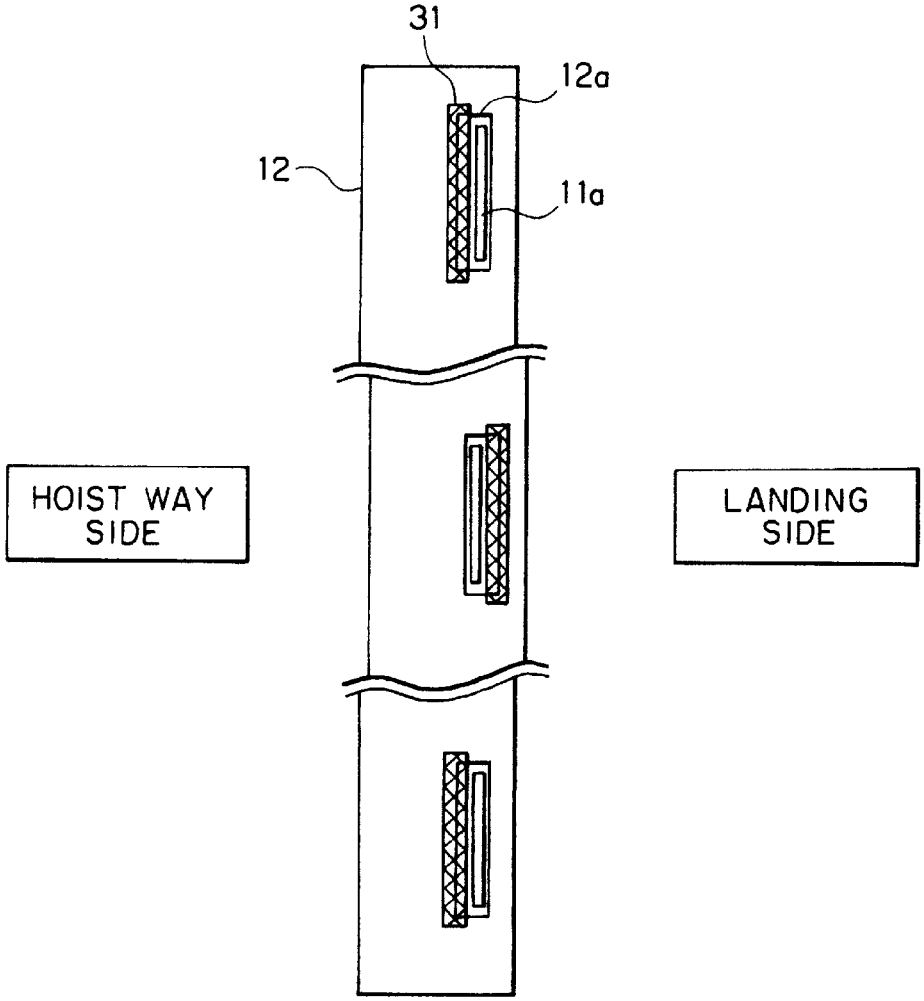
FIG. 5 is a schematic view showing an essential portion of an elevator door apparatus in accordance with a fourth embodiment of the present invention.

Next, FIG. 5 is a schematic view showing an essential portion of an elevator door apparatus in accordance with a fourth embodiment of the present invention. In this embodiment, the thermal expansion members 31 are attached only to the side where gaps are generated when the landing doors 6 are deformed by fire so that the engaging portions 11*a* are brought into contact with the side edge portions of the insert holes 12*a*. That is to say, each thermal expansion portion 31 at upper and lower portions of the landing doors 6 is disposed at the hoist way side, and each thermal expansion portion 31 at the central portion of the height of the landing doors 6 is disposed at the landing side. Consequently, the gaps of the insert holes 12*a* can be effectively closed, so that the quantity of the thermal expansion members 31 used can be reduced.

Fifth Embodiment

Figure 6:
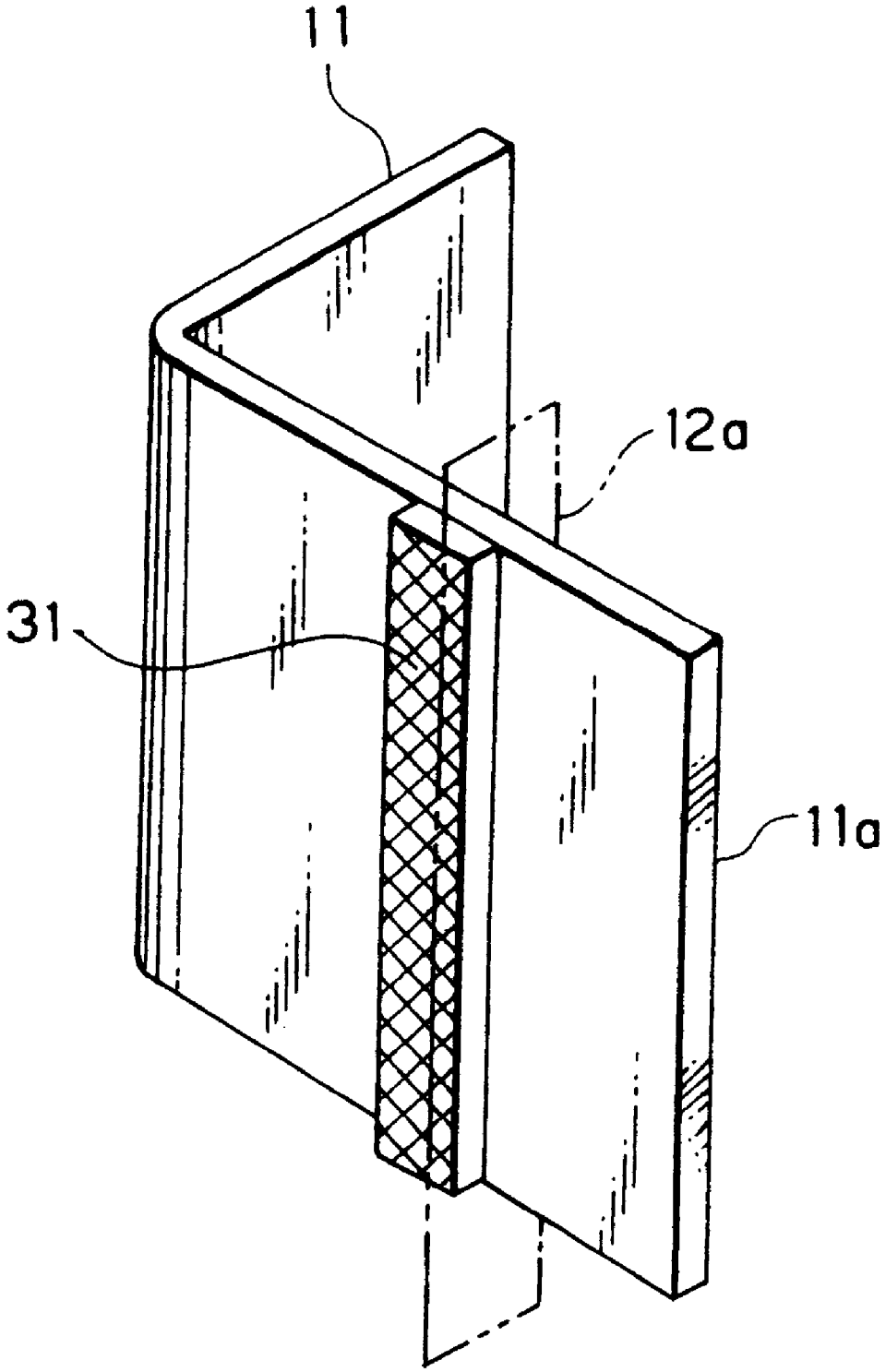
FIG. 6 is a perspective view showing an essential portion of an elevator door apparatus in accordance with a fifth embodiment of the present invention.
Figure 7:
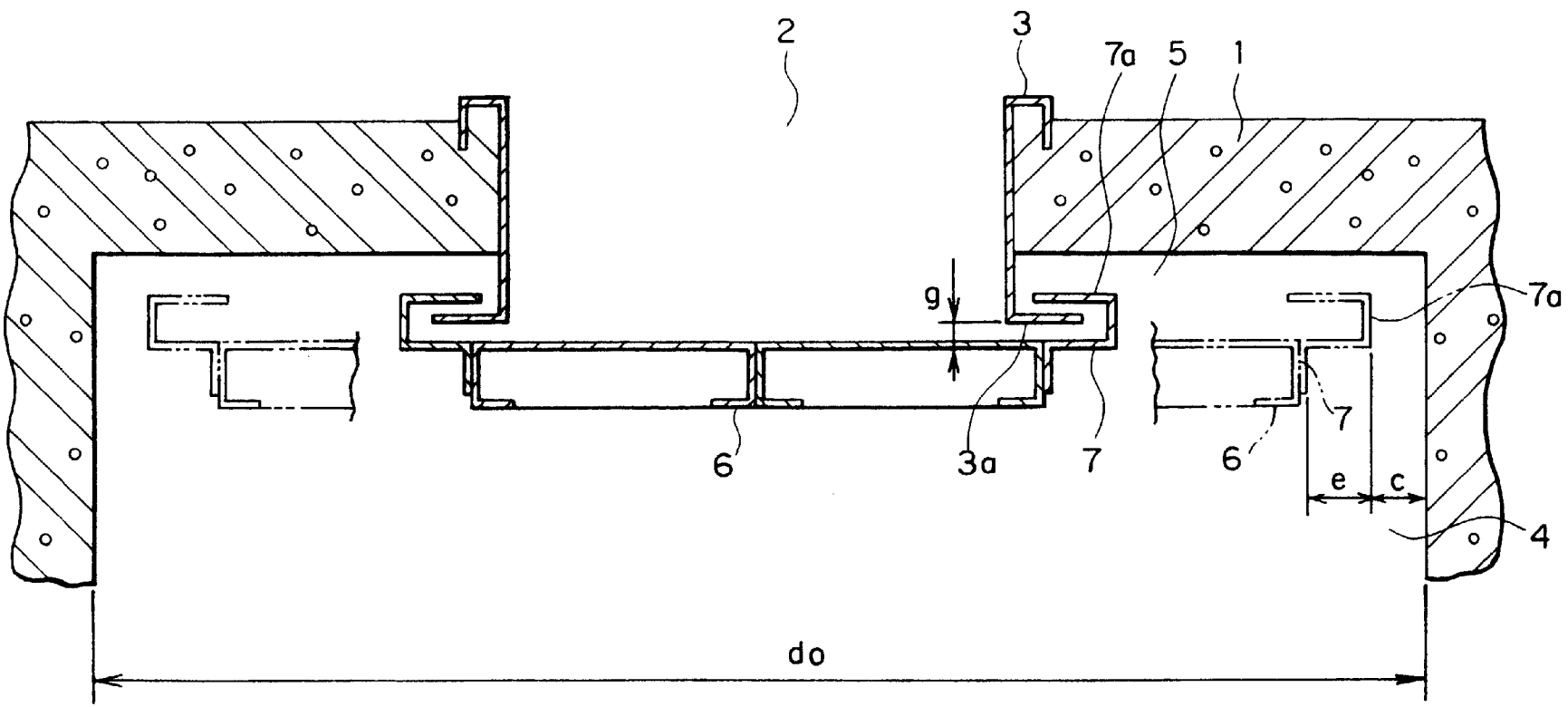
FIG. 7 PRIOR ART
FIG. 7 is a horizontal cross sectional view showing an example of a conventional elevator door apparatus.

Although the thermal expansion members 31 in the above embodiment are attached to the door side fire protection members 12, as shown in FIG. 6 for example, the thermal expansion members 31 may be attached to the engaging portions 11*a*. Furthermore, in this case as well, the deformation of the landing doors 6 is taken into consideration and it is preferable that each thermal expansion portion 31 at upper and lower portions of the landing doors 6 be disposed at the hoist way side, and each thermal expansion portion 31 at the central portion of the height of the landing doors 6 be disposed at the landing side. In this door apparatus, since the thermal expansion members 31 are fixed to the landing and are not moved together with the landing doors 6, the thermal expansion members 31 are prevented from coming off due to vibration.

What is claimed is:

1. An elevator door apparatus, comprising:

a landing door for opening and closing an entrance of a landing;

a landing fire protection member fixed at a door recess portion of said entrance and having an engaging portion extending in a direction parallel to an opening and closing direction of said landing door; and a plate-shaped door side fire protection member fixed to a side end portion of said landing door and extending in a direction perpendicular to the opening and closing direction of said landing door, said door side fire protection member having an insert hole in which said engaging portion is inserted when said landing door is closed.

2. The elevator door apparatus according to claim 1, wherein a plurality of said engaging portions and a plurality of said insert holes are disposed such that they have an interval therebetween in a height direction of the landing door, and at least one of said engaging portions and said insert holes differs in strength according to position in the height direction of the landing door to correspond to the magnitude of force generated by the warping of said landing door when there is a fire.

3. The elevator door apparatus according to claim 1, including a thermal expansion member that expands when said landing door is deformed by fire to close said insert hole located between the engaging portion and the door side fire protection member.

4. The elevator door apparatus according to claim 3, wherein the thermal expansion member is provided only at one of a landing side and a hoist way side of said engaging portion to corresponding position in a height direction of said landing door.

5. The elevator door apparatus according to claim 3, wherein said thermal expansion member is fixed to said engaging portion.

* * * * *